US007992242B2

(12) United States Patent
Antinori

(10) Patent No.: US 7,992,242 B2
(45) Date of Patent: Aug. 9, 2011

(54) MATTRESS HAVING A ZONED SPRING UNIT WITH FIRMNESS INDICATING ZONES FORMED BY A MULTIPLE COLORED TOP PANEL

(75) Inventor: Steven J. Antinori, Tampa, FL (US)

(73) Assignee: American Bedding Industries, Tampa, FL (US)

( * ) Notice: Subject to any disclaimer, the term of this patent is extended or adjusted under 35 U.S.C. 154(b) by 1209 days.

(21) Appl. No.: 11/528,604

(22) Filed: Sep. 28, 2006

(65) Prior Publication Data

US 2007/0017033 A1 Jan. 25, 2007

Related U.S. Application Data

(63) Continuation-in-part of application No. 10/446,729, filed on May 29, 2003, now Pat. No. 7,870,626.

(51) Int. Cl.
*A47C 23/05* (2006.01)
*A47C 17/86* (2006.01)

(52) U.S. Cl. ..... 5/727; 5/717; 5/737

(58) Field of Classification Search ..... 5/716, 717, 5/721, 727, 737, 739
See application file for complete search history.

(56) References Cited

U.S. PATENT DOCUMENTS

| | | | | |
|---|---|---|---|---|
| 2,469,084 | A | | 5/1949 | Schenker |
| 2,836,228 | A | | 6/1956 | Dahle |
| 3,210,781 | A | | 10/1965 | Pollock |
| 4,086,675 | A | | 5/1978 | Talbert et al. |
| 4,405,681 | A | | 9/1983 | McEvoy |
| 4,679,266 | A | * | 7/1987 | Kraft ..... 5/716 |
| 4,794,658 | A | * | 1/1989 | Goodale ..... 5/737 |
| 5,065,485 | A | | 11/1991 | Zocco |
| 5,105,488 | A | | 4/1992 | Hutchinson et al. |
| 5,107,559 | A | | 4/1992 | Lueck |
| 5,136,740 | A | * | 8/1992 | Kraft ..... 5/730 |
| 5,430,901 | A | | 7/1995 | Farley |
| 5,475,881 | A | | 12/1995 | Higgins et al. |
| 5,568,659 | A | | 10/1996 | Fogel |
| 5,579,549 | A | | 12/1996 | Selman et al. |
| 5,701,623 | A | | 12/1997 | May |
| 5,960,496 | A | | 10/1999 | Boyd |
| 5,987,678 | A | * | 11/1999 | Ayers ..... 5/720 |
| 6,122,787 | A | * | 9/2000 | Kao ..... 5/723 |
| 6,151,739 | A | | 11/2000 | Meyer et al. |
| 6,256,821 | B1 | | 7/2001 | Boyd |
| 6,351,863 | B1 | | 3/2002 | Meyer et al. |
| 6,779,369 | B2 | * | 8/2004 | Shepherd ..... 66/196 |
| 2005/0223667 | A1 | | 10/2005 | McCann et al. |
| 2005/0229318 | A1 | | 10/2005 | Peng |

* cited by examiner

*Primary Examiner* — Michael Safavi
(74) *Attorney, Agent, or Firm* — Reed Smith LLP

(57) ABSTRACT

A zoned mattress including at least a head firmness zone, a leg firmness zone between the head and leg firmness zones overlaid by a knit top fabric knit from threads of at least two different colors to define three different firmness indicating areas corresponding to the three firmness zones of the mattress. At least one of the firmness indicating areas is defined by threads differing in color as compared to the color of the threads defining at least one of the two remaining firmness indicating areas.

15 Claims, 6 Drawing Sheets

FIG. 8

MATTRESS HAVING A ZONED SPRING UNIT WITH FIRMNESS INDICATING ZONES FORMED BY A MULTIPLE COLORED TOP PANEL

CROSS-REFERENCE TO RELATED APPLICATIONS

This application is a continuation-in-part application of Applicant's commonly assigned application in Ser. No. 10/446,729 filed on May 29, 2003 entitled "A Mattress Having a Spring Unit with a Single Upper Peripheral Border Rod Locked Within a Chamber of a Synthetic Foam Plastic Material Housing," and now U.S. Pat. No. 7,870,626.

BACKGROUND OF THE INVENTION

Conventional mattresses are constructed in many different ways to provide uniform or varied firmness along their lengths, such as conventional coil spring mattresses or synthetic foam mattresses. Other mattresses include housings made of synthetic polymeric/copolymeric plastic material generally formed by upper and lower layers or panels and a peripheral border therebetween. In one type of mattress one or more synthetic plastic material panels are housed within the chamber of the mattress housing. In another type mattress a spring unit or a series of springs or inflatable units or conventional natural fibers are similarly housed within the chamber of such mattress housings. A further mattress includes both one or more panels of synthetic plastic material and coil springs housed within a chamber of a mattress housing.

All such mattresses are said to have a variety of different advantages, and typical of mattresses defined by a synthetic plastic material mattress housing defining a chamber in which are housed one or more layers of polymeric/copolymeric plastic material, including foam, are McEvoy, U.S. Pat. No. 4,405,681 issued on Sep. 20, 1983; Dahle, U.S. Pat. No. 2,836,228 issued on Jun. 15, 1956; Luck, U.S. Pat. No. 5,107,559 issued on Apr. 28, 1992; Talbert et al., U.S. Pat. No. 4,086,675 issued on May 2, 1978 and May, U.S. Pat. No. 5,701,623 issued on Dec. 30, 1997. Such mattresses are said to advantageously provide desired support, differential hardnesses, extremely high resistance to compression, resilience to return from a compressed condition substantially to the original uncompressed form, differential firmness, edge firmness and softer centers, etc.

Much the same advantages are claimed for mattresses in which a spring unit or individual spring coils are housed within a chamber of a synthetic plastic material mattress housing with or without synthetic plastic panels also being housed within the chamber. Typical of the latter mattresses can be found in Zocco, U.S. Pat. No. 5,065,485 issued on Nov. 19, 1991; Pollock, U.S. Pat. No. 3,210,781 issued on Oct. 12, 1965; Schenker, U.S. Pat. No. 2,469,084 issued on May 3, 1949; Kraft, U.S. Pat. No. 5,136,740 issued on Aug. 11, 1992 and Hutchinson et al., U.S. Pat. No. 5,105,488 issued on Apr. 21, 1992. Though the latter type mattresses exhibit numerous advantages, a major disadvantage is the "swimming pool" effect of the coil spring unit and the synthetic polymeric/copolymeric synthetic plastic material housing. Heretofore such spring units continuously floated or shifted within the associated chamber of the plastic mattress housing ("swimming pool" effect) which created excessive wear and increased the return rate of such mattresses which quickly deteriorated over a short period of time as the inner surfaces or walls defining the mattress housing deteriorated under continuous rubbing and grinding of the spring unit as it continuously shifted when in use. Normally such coil spring units are defined by a number of coils and upper and lower heavier peripherally extending border rods which are attached to the coils by clips. When such coil spring units are loosely dropped into and are housed loosely within the chamber of an associated plastic mattress the clips and the upper and lower border rods rub and grind away at the inner surfaces or walls of the peripheral border and/or the upper and/or lower panels of the plastic mattress housing.

Such conventional mattresses utilizing spring units formed by both upper and lower relatively rigid peripheral border rods clipped to upper and lower coil loops of coils are also extremely rigid and are not susceptible to bending either transversely or longitudinally, as is oft times desired when mattresses are transported, removed, installed, flipped, etc. Such rigidity in conventional coil spring/foam housing mattresses also creates a transition area between the upper border rod and the spaced peripheral border of the mattress housing which creates an undesired peripheral gap and/or lump between the two which is noticeable when a person sits upon an edge of the mattress.

Conventional mattresses utilizing sprint units or innersprings can also be zoned to provide varying firmness or resistance to vertical deflection in response to a person lying upon or shifting relative to the mattress. Typically, a conventional mattress is divided into at least three longitudinal zones of differing firmness or resistance to vertical deflection in order for the body of a person lying atop the mattress to be supported with minimum pressure at high pressure points on the body. One such zone mattress is disclosed in U.S. Pat. No. 5,475,881 granted to Larry Higgins et al. on Dec. 19, 1995 and includes in conjunction with the mattress zoning a top, pad or panel which has a quilting pattern divided into four longitudinal zones reflecting and identifying the location and position of four underlying longitudinal firmness zones of the core mattress/innerspring located beneath the cover. The quilting pattern thereby enables a person sleeping atop the mattress to identify where the head, hips, legs and feet should be located on the top of the mattress so as to maximize the comfort imparted by the underlying mattress firmness zones. The quilting pattern also varies in size in different zones such that the closer the quilting pattern, the greater is the restriction to fabric movement and thus more firmness is imparted to that particular section of the mattress by the top or cover. Stated otherwise, a close or tight quilting pattern of quilted seams is located over the more firm section of the mattress and a looser pattern is located over the less firm section of the mattress.

SUMMARY OF THE INVENTION

The invention herein provides a mattress formed of synthetic polymeric/copolymeric plastic material, preferably foam plastic, which forms a mattress housing defined by a lower foam panel, an upper foam panel and a peripheral foam border formed of one, two or more pieces of material collectively defining a spring unit chamber. A spring unit of the mattress of this invention includes a plurality of coil springs having upper and lower loops to the upper loops of which is connected by clips a peripheral border rod. The coil spring unit includes only one peripheral border rod and the latter is located only at the upper side of the coil spring unit. The overall length and width of the border rod is exactly equal to, slightly larger than or somewhat larger than the corresponding dimensions of the inner walls or surfaces of the peripheral border of the housing. Accordingly, with the bottom panel adhesively bonded to the peripheral border, the coil spring unit is dropped-in a chamber of the mattress housing from above with the lower coil loop of each coil spring resting upon an innermost surface of the lower panel. The border rod must be forced down into the chamber and if the peripheral dimensions thereof correspond substantially identically to the peripheral dimensions of the housing border, the upper border rod and its clips are in frictional locking relatively immobilized relationship to the inner wall or surface of the peripheral border of the housing. However, the dimensions of the inner walls or surfaces of the border are preferably foreshortened ¼-½ inch relative to the same dimensions of the upper border rod which during assembly causes the synthetic foam plastic material along an innermost upper edge of the border to compress and essentially lockingly grip the peripheral border rod along the upper edge of the plastic material border when the coil spring unit is fully seated within the mattress chamber. The latter locking avoids the "swimming pool" effect earlier described while the absence of any further peripheral border rods and particularly a lower peripheral border rod permits the mattress to be bent as earlier described.

Instead of oversizing the length and width of the upper peripheral border rod relative to the respective length and width of the mattress chamber dimensions, the height of the coil spring unit can be ¼-½ inch higher than the distance between the inner opposing surfaces of the upper and lower panels which would be the same as the height of the mattress border as defined between upper and lower surfaces thereof. After the lower panel has been adhesively bonded to the mattress border and the coil spring unit has been placed therein, the upper peripheral border rod would project the ¼-½ inch above the upper surfaces of the mattress border. However, as the upper panel is placed atop the coil spring unit and is pushed downwardly, the upper peripheral border rod and its clips embed into the inner surface of the upper panel creating a peripherally extending downwardly opening locking channel which prevents the "swimming pool" effect after the mattress has been completed by adhesively uniting the upper panel to the upper surface of the mattress peripheral border.

In further keeping with the present invention, the overall peripheral size and height of the coil spring unit can be ¼-½ inch greater than the corresponding dimensions of the chamber of the mattress housing. When finally assembled, the upper peripheral border rod will lock both with the upper interior surface of the housing border and the inner surface of the upper panel in respectively peripherally extending inwardly opening and downwardly opening locking grooves or channels.

In further accordance with the present invention, in lieu of the utilization of a quilted top or pad having unique quilting patterns applied thereto of different sizes and firmness, the top panel or pad of the present invention includes an outermost exterior exposed knit fabric formed from threads of two different colors with the threads at the exterior surface of the top fabric being knitted to define at least three different firmness indicating areas corresponding to three firmness zones of the innerspring, and at least one of the firmness indicating areas of the knit top fabric is defined by threads differing in color as compared to the color of the threads defining at least one of the two remaining firmness indicating areas. By this construction of the knit top fabric, which is also preferably defined by an inner surface of but a single color of knit threads, the correct fabrication of the overall top, pad or panel is assured and irrespective of any particular knitted design evident in the exterior top fabric, it is the color of the threads at the exterior of the top fabric which delineates or indicates the underlying firmness zones of the coil spring units/innerspring.

DETAILED DESCRIPTION OF THE PREFERRED EMBODIMENTS

Figure 1:
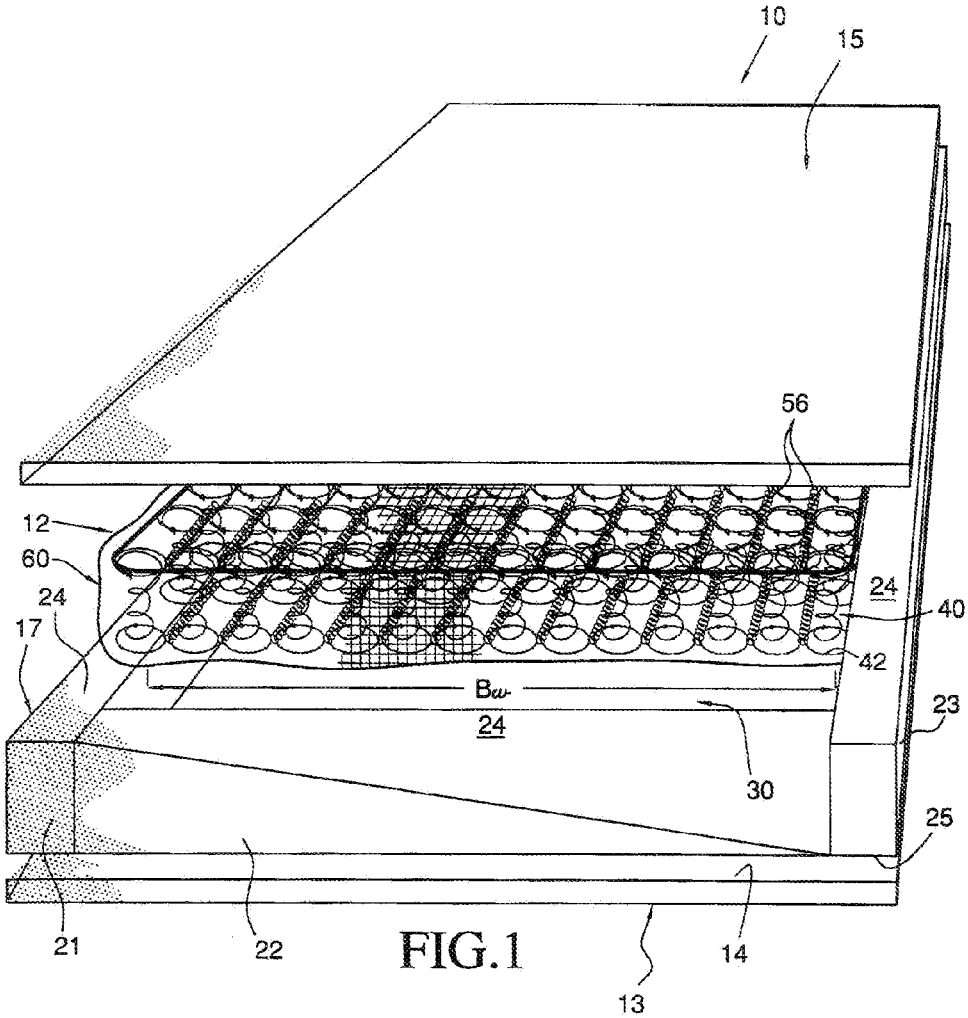
FIG. 1 is an exploded perspective view of a novel mattress constructed in accordance with this invention, and illustrates upper and lower panels and a polygonal border constructed from synthetic plastic material defining a chamber in which is housed a spring unit including only a single upper peripheral border rod united by clips to upper loops of a plurality of coil springs.
Figure 2:
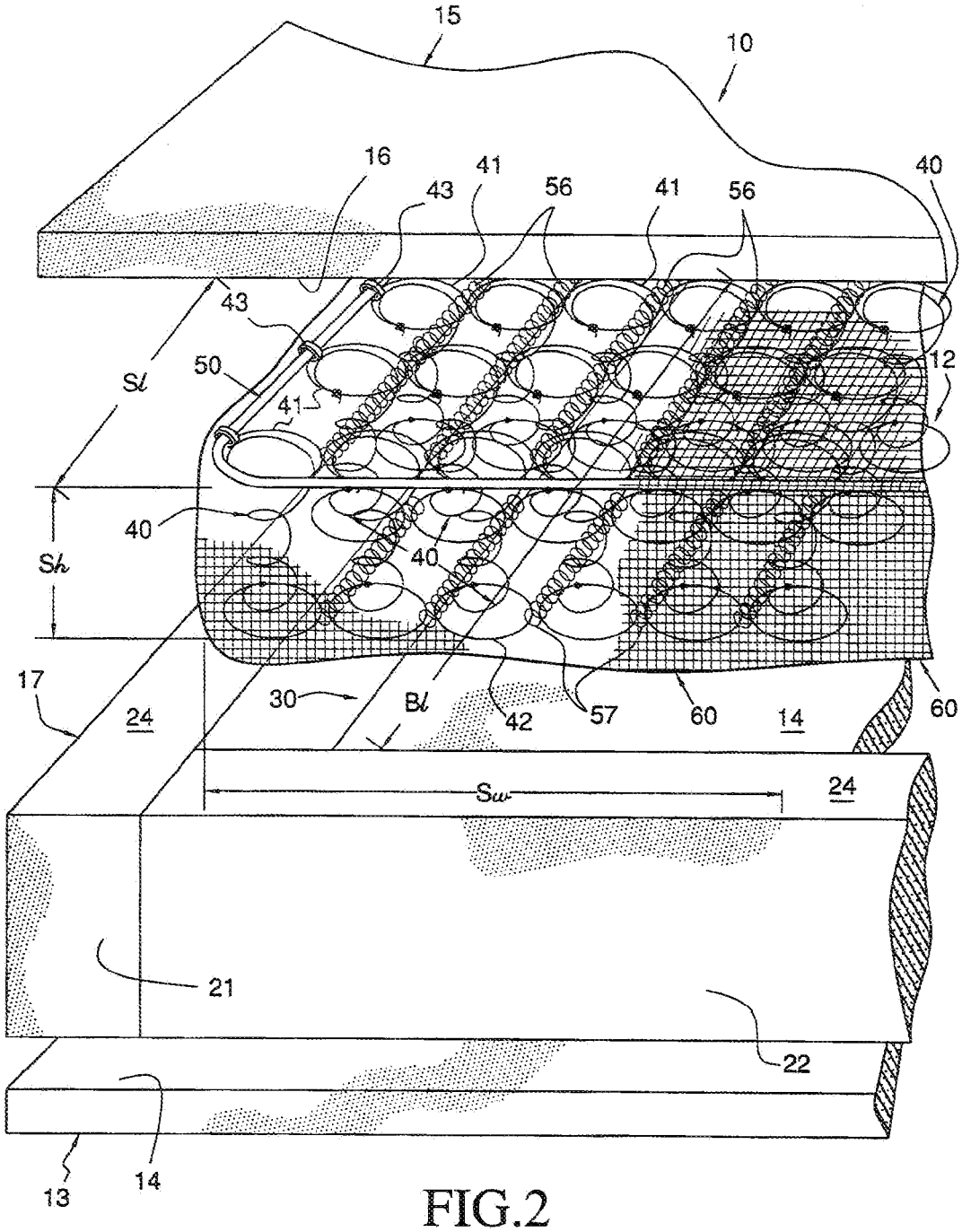
FIG. 2 is a fragmentary exploded perspective view of the mattress of FIG. 1, and illustrates details of the coil spring unit including upper and lower bonnell lacings uniting upper and lower loops of coil springs from head end to foot end of the mattress to prevent roll together.
Figure 3:
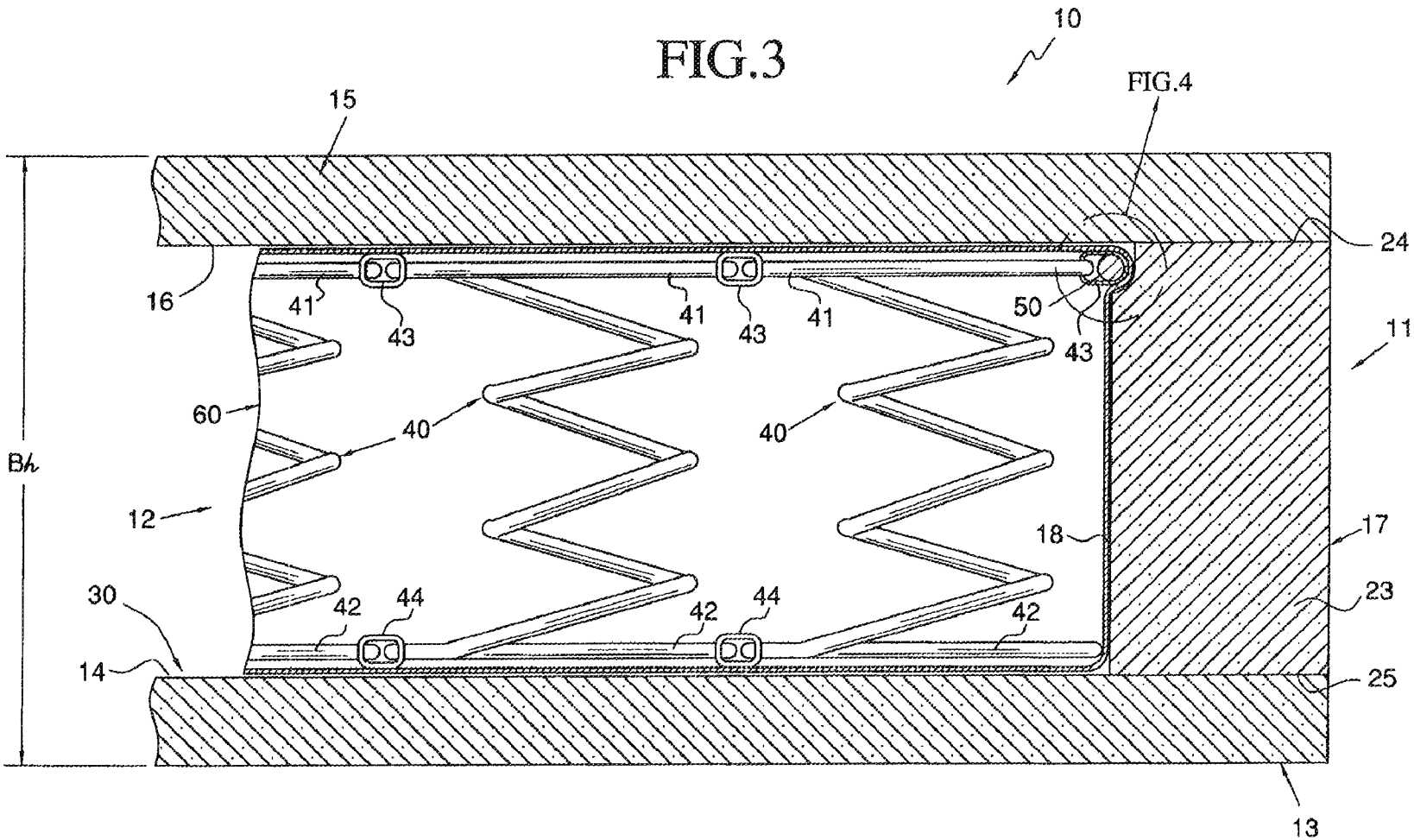
FIG. 3 is a fragmentary vertical cross-sectional view taken through the assembled mattress and illustrates the upper and lower panels adhesively bonded to the housing border and the upper peripheral border rod locked in an inwardly opening peripheral extending groove of the housing border formed during the force-fit assembly of the coil spring unit into the mattress housing chamber.

A novel mattress constructed in accordance with this invention is illustrated in FIGS. 1 through 3 of the drawings and is generally designated by the reference numeral 10.

The mattress 10 is defined by a synthetic foam plastic mattress housing 11 and a coil spring unit 12 (FIG. 3).

The mattress housing 11 is defined by a substantially rectangular or polygonal lower or bottom panel 13 having an innermost surface or wall 14, and an upper substantially polygonal or rectangular panel 15 having an innermost surface or wall 16 and a border 17 having an inner peripheral surface or wall 18. The border 17 can be a single molded component or can be a single piece of material bent at three corners and glued at a fourth corner or can be made of a plurality of individual border members, such as three of four border members illustrated in FIG. 1 and individually identified by reference numerals 21, 22 and 23. The border 17 includes an upper surface 24 and a lower surface 25 which defines a border height Bh. The inner peripheral surface or wall 18 of the border 17 also defines an inner border width Bw and an inner border length Bl (FIGS. 1 and 2). The dimensions Bh, Bw and Bl define the overall dimensions of a chamber 30 in which is housed the coil spring unit 12.

The coil spring unit 12 includes a plurality of identical bonnell coils or coil springs each being designated by the reference numeral 40 and each having respective upper and lower opposite loop portions 41, 42 positioned respectively adjacent the inner surfaces 16, 14 of the respective upper and lower panels 15, 13 in the completely assembled mattress 10, as is shown in FIG. 3. A selected plurality or all of the upper loop portions 41 are connected to each other by conventional metallic clips 43 as are the lower loop portions 42 by similar conventional metallic clips 44. A relatively rigid metallic peripheral border rod 50 is located in exterior surrounding relationship to the upper loop portions 41 of the peripherally outermost coil springs 40. The metallic clips 43 connect the peripheral border rod 50 to the upper loop portions 41 of the coil springs 40 extending along the long sides of the border 17 but need not necessarily be united to the uppermost loops in the row adjacent each of the short sides or width of the border 17, as is readily apparent from FIG. 2 of the drawings. However, the clips 43 can also be used to connect the peripheral border rod 50 to the upper loop portions 41 of the coil springs 40 in the row of coil springs most adjacent the short sides (head and foot ends) of the mattress. However, head end to foot end bonnell lacings are "laced" longitudinally to connect the upper loop portions 41 and the lower loop portions 42 of all longitudinally extending rows of coil springs 40 with the upper and lower lacings being respectively identified by reference characters 56 and 57 in FIG. 2 of the drawings. The springs 40 are also preferably spaced closer together toward the middle of the mattress 10 than at the head and foot ends to provide better support where a supine body needs it most. A plastic netting or mesh 60 encases all of the coil springs 40 and the peripheral border rod 50.

The coil spring unit 12 has a height Sh (FIG. 2), a length Sl and a width Sw. The dimensions Sh, Sl and Sw of the coil spring unit 12 correspond to the respective dimensions Bh, Bl and Bw of the chamber 30. In accordance with this invention, one or more relative dimensions Sh, Sl and/or Sw define at a minimum a frictional fit relationship, more preferably a force-fit relationship, and still more preferably an oversize fit of between ¼-½ inch relative to the corresponding dimensions Bh, Bl and/or Bw. In this manner at least one dimension, length, width or height of the coil spring unit 12 is greater than at least one dimension, length, width or height of the chamber 30 which assures that the coil spring unit 12 is virtually immovably interlocked within the chamber 30. More specifically, in keeping with the mattress 10 thus far described, both the spring unit length Sl and the spring unit width Sw which are measurements of the respective length and width of the peripheral border rod 50 are ¼-½ inch greater in size than the respective dimensions Bl and Bw defining the interior length and width of the chamber 30 of the mattress housing 10. Therefore, as the spring unit 12 is lowered into the chamber 30, after the surfaces 14, 25 of the respective lower panel 13 and border 17 have been adhesively bonded to each other, the peripheral border rod 50 and the clips thereof contact the upper surface 24 of the border 17 because of the oversized peripheral dimension of the upper border rod 50 as compared to the peripheral dimension of the inner surface 18 of the border 17. As the spring unit 12 is forced downwardly into the chamber 30 the upper edge of the inner peripheral surface 18 becomes distorted and, in a preferred embodiment of the invention in which the border 17 is constructed from foam material, the foam is crushed to form interlocking means 70 (FIG. 4) in the form of an inwardly opening peripherally extending channel 70 which immobilizes the coil spring unit 12 within the chamber 30. The lower interior surface 16 of the upper panel 15 is then bonded to the upper peripheral surface 24 of the border 17. As is most evident from FIG. 3, the lower loop portions 42 are unconstrained relative to the inner peripheral surface 18 of the border 17 because of the absence thereat of a peripheral border rod corresponding to the upper peripheral border rod 50. Thus the interlocking means 70 assures the "swimming pool" effect is eliminated while at the same time providing a mattress 10 of superior characteristics which can be bent considerably about its length or width, again because of the absence of any peripheral border rods beyond the border rod 50.

Figures 4, 5, 6:
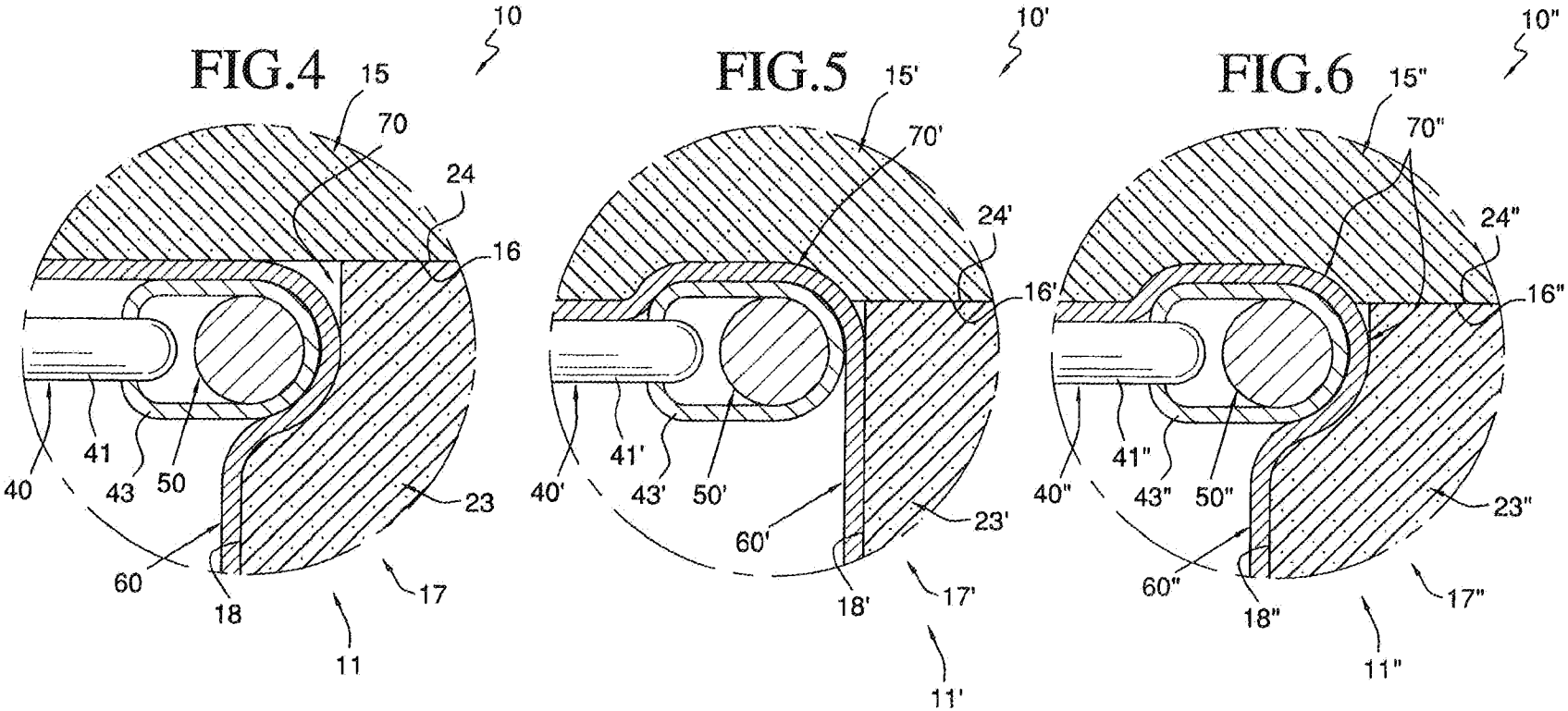
FIG. 4 is a fragmentary enlarged cross-sectional view of the encircled portion of FIG. 3, and more clearly illustrates the manner in which the upper peripherally extending border rod and one of the clips is locked in the locking channel formed by deformation of the mattress housing border during assembly.
FIG. 5 is an enlarged fragmentary view of another mattress taken in the same area as that of FIG. 4, but illustrates the manner in which the upper peripheral border rod is locked in a downwardly opening peripherally extending channel of the upper panel of the mattress housing caused by the compression of the plastic material during assembly.
FIG. 6 is an enlarged fragmentary cross-sectional view of another mattress taken through the same area as FIG. 4, and illustrates the manner in which both the peripheral border and the upper panel are deformed or distorted during assembly to form a locking channel in each for locking the upper peripheral border rod and its clips therein.

In further accordance with the present invention, a mattress 10' is illustrated in FIG. 5 which is identical in construction to the mattress 10 except the dimensions Bl, Sl and Bw, Sw are substantially the same but the height Sh of the coil spring unit 12 as measured from the top of the peripheral border rod 50 and the lowest loop portions 42 of the coil springs 40 is ¼-½ inch greater than the distance or height Bh (FIG. 3) of the chamber or compartment 30. Thus, peripheral locking means 70' is formed in the inner surface 16 of the upper panel 15 when the latter is forced downwardly upon the coil spring unit 12'. In this case the locking or interlocking means 70' is effected between only the upper panel 15' and the spring unit 12' whereas the border 17' includes its normal undeformed inner peripheral surface 18'.

A mattress 10" of FIG. 6 includes interlocking means 70" which is defined by both of the interlocking means 70, 70' of respective FIGS. 4 and 5 heretofore described. In other words, the locking or interlocking means 70" is achieved by dimensioning all three dimensions Sh, Sl and Sw of the coil spring unit 12 greater than the respective dimensions Bh, Bl and Bw of the chamber 30. The locking or interlocking means 70" is thereby effected between the coil spring unit 12" and both the inner surface 16" of the upper panel 15" and the inner peripheral surface 18" of the border 17".

Figures 7, 8:
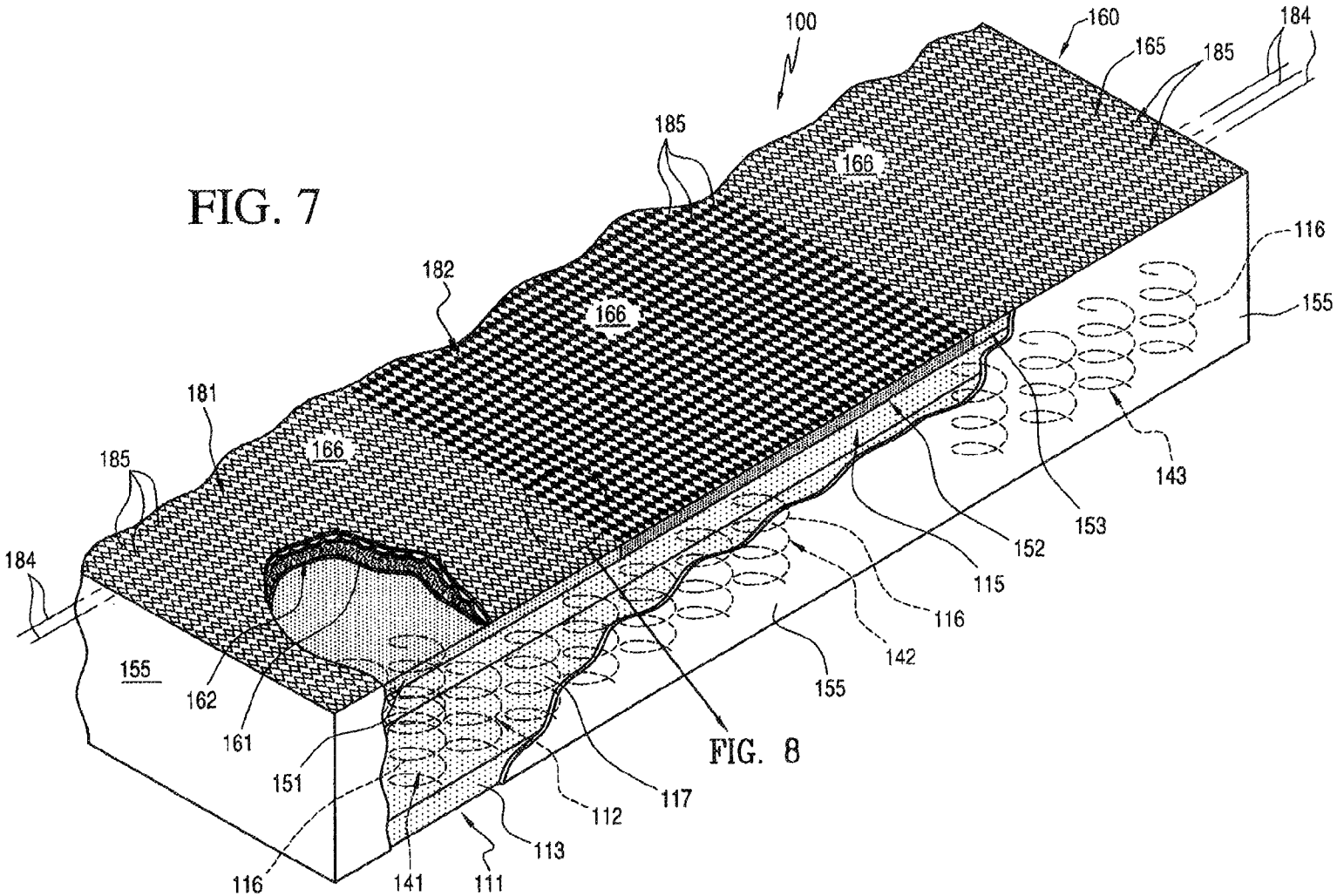
FIG. 7 is a fragmentary perspective view of a mattress having three zones of firmness defined by an innerspring or coil spring unit, and illustrates in association therewith a top, pad or panel defined by an outermost top fabric knit from threads of at least two different colors with the two different colors defining three firmness zones visually apparent from the exterior of the mattress which are indicative of the underlying firmness zones of the spring unit.
FIG. 8 is an enlarged fragmentary view of the encircled portion of the knit top fabric of the top panel of FIG. 7, and illustrates the manner in which two different colors of the threads associated with two different areas reflect the corresponding firmness of the underlying firmness zones of the spring unit or innerspring.
Figure 8:
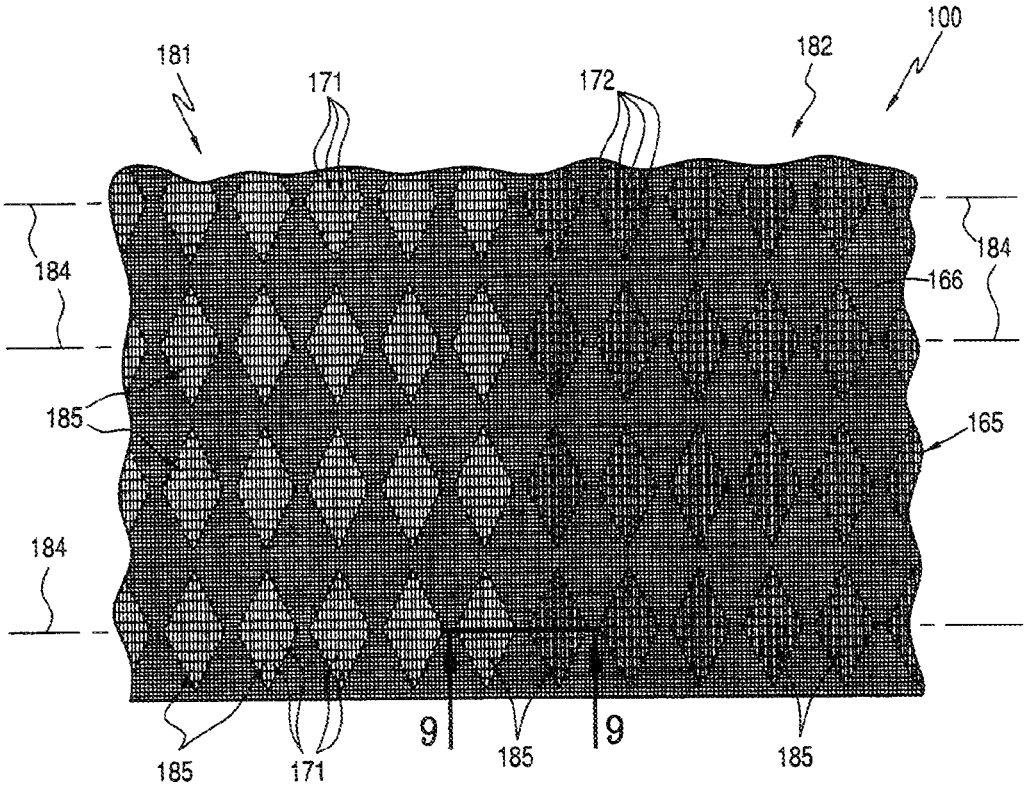
Figure 9:
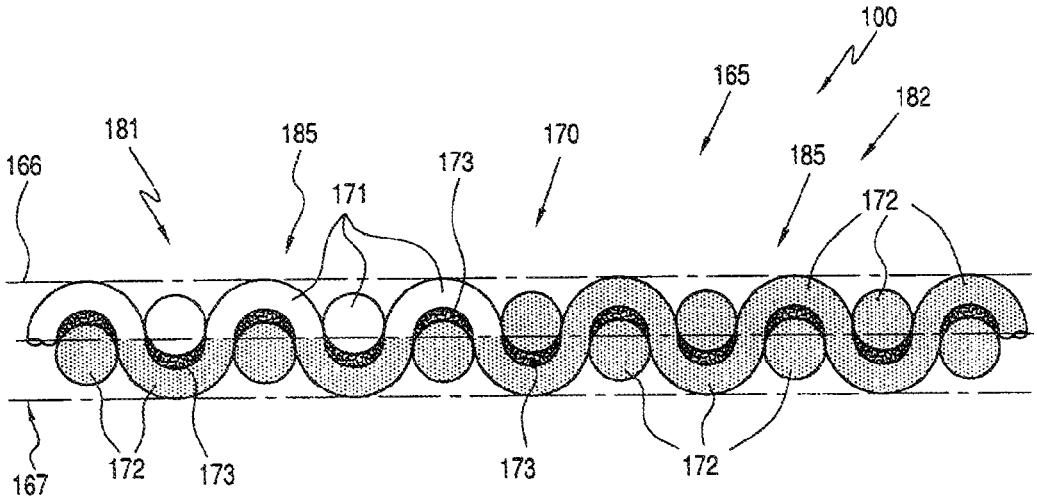
FIG. 9 is an enlarged cross-sectional view taken through the knit fabric along line 9-9 of FIG. 8, and illustrates the two different colored threads of the two different firmness indicating areas of the top knit fabric.

Another novel mattress constructed in accordance with this invention is illustrated in FIGS. 7 through 9 of the drawings and is generally designated by the reference numeral 100.

The mattress 100 is defined by a synthetic foam plastic mattress housing 111 and a coil spring unit 112.

The mattress housing 111 corresponds substantially to the mattress housing 11 of the mattress 10 and includes a substantially rectangular or polygonal lower or bottom panel 113, an upper substantially polygonal or rectangular panel 115 and a peripheral border 117.

The coil spring unit or innerspring 112 includes a plurality of bonnell coils or coil springs 116 which set-off or define at least three zones of firmness including at least a head firmness zone 141, a torso or lumbar firmness zone 142 and a foot or leg firmness zone 143. Mattresses having such firmness zones are conventional and one such mattress having four different zones of firmness is disclosed in U.S. Pat. No. 5,475,881 in the name of Larry Higgins et al. granted on Dec. 19, 1995. As disclosed in the latter patent, in the case of a mattress coil spring unit or core formed of coil springs, such as the coil springs 146, the differing firmness of the differing zones 141-143 result from springs of different characteristics within each of the zones. The differing firmness may be the result of differing gauge wire utilized to manufacture the springs 116 in each zone or of different styles of coils or springs of differing metal compositions, or combinations thereof. The mattress 100 is preferably firmest in the center zone 142 and of lesser firmness at the firmness zones 141, 143 to either side thereof. Overlying the firmness zones 141-143 and adhesively bonded to an upper surface (unnumbered) of the upper polygonal panel 115 are respective variable firmness panels 151, 152 and 153 with the center or torso firmness panel 152 being more firm and less compressible than the head or foot firmness panels 151, 152, respectively. The panels 151-153 also provide variable firmness irrespective of the particular material from which each is made with the center panel 152 being made of firmer less compressible material than the material of the firmness panels 151 and 153. A fabric covering 155 covers the entirety of the components of the mattress 100 thus far described.

In further accordance with the present invention, the mattress 100 includes a top panel or topper 160 defined by a polygonal or rectangular piece of fabric material 161 (FIG. 7) which is peripherally sewn to a knit top fabric 165 and defines therewith a chamber 162 filled with relatively soft cushioning material such as non-woven fabric batting material and/or a thin ply or pieces of urethane foam material which assures that a person lying atop the mattress 100 will distribute his or her weight as evenly as possible over the maximum surface area possible to create increased comfort.

The invention is particularly directed to the knit top fabric 165 of the topper or top panel 160 which is best illustrated in FIGS. 8 and 9 of the drawings. The knit top fabric 165 includes a top surface 166 and a bottom surface 167 set off by threads 170 of at least two different colors which, for purposes of description, are a plurality of white threads 171 and colored threads 172, such as tan or gold, and circularly knitted therebetween and therewith are polyester inlay threads or yarn 173 (FIG. 9) generally of a neutral or opaque color which are indiscernible when the knit top fabric 165 is viewed from above the top surface 166 or from below the bottom surface 167 thereof. The plurality of threads 170 of FIG. 9 are diagrammatically illustrated for the purpose of reflecting different color characteristics of the overall top panel 165 and particularly the appearance of the top surface 166 thereof. However, the fabric 165 is preferably knitted upon a circular knitting machine, such as the OVJA 1.6 E 511 manufactured and sold by Mayer & Cie of Germany which through positive needle guidance, diagonal stitch-forming and electronic individual needle selection in conjunction with electronic pattern resetting in externally resettable cams offers reliable pattern repetition in bulk tip-top jacquard qualities. Depending upon the particular control of the conventional circular knitting machine, virtually any particular pattern desired can be knitted using virtually any number of different colored threads 170 to form the knitted top fabric panel 165. In the present case the pattern selected is such that the threads 171, 172 exposed at the top surface 166 when viewed from above define three different firmness indicating areas or firmness indicating zones 181, 182 and 183 (FIG. 7) corresponding in size and profile and overlying the respective head firmness zone 141, the torso firmness zone 142 and the foot firmness zone 143. The specific pattern of the knit fabric 165 both at the top surface 166 and at the bottom surface 167 is a plurality of longitudinally extending substantially parallel spaced rows 184 of knitted diamond areas 185 which from row-to-row are also in spaced aligned tip-to-tip opposing relationship, as is most readily apparent from FIG. 8 of the drawings. As is best indicated in FIG. 8 and in the diagrammatic cross-sectional view of FIG. 9, the individual diamond shaped areas 185 are formed by white threads 171 circularly knit into the top surface 166 of the firmness indicating zones 181, 183, but in the center firmness indicating zone 182 the diamond shaped circularly knitted areas 185 are formed by the colored threads 172 (gold or tan) which clearly distinguishes the firmness indicating zone 182 from the firmness indicating zones 181, 183 (FIG. 7). The bottom surface 167 of the knitted top fabric 165 is formed only by colored threads 172. Therefore, when viewed from below, the interior or bottom surface 167 is formed of threads 172 of a single color, such as gold or tan, but lacks white or similar threads 171 which provide the marked contrast obvious in FIG. 7 in which the exposed colored/darker threads 172 at the top surface 166 clearly delineate or define the torso firmness indicating zone 182, as opposed to the lighter firmness indicating zones 181, 183 effected by the exposed white threads 171 at the top or upper surface 166 thereof. Therefore, though the pattern of the entire circular knit top fabric or top panel 165 is identical when viewed from the top surface 166 and the bottom surface 167, the bottom surface 167 is defined throughout its entire area only by the colored threads 172, whereas the colored threads 172 at the top surface 166 define or delimit the torso indicating firmness zone 182. The latter relationship assures that during manufacture, fabrication of the mattress 100 cannot be done incorrectly because workers can simply look at the knit top fabric panel 165 and know that the "all-dark" side goes down (dark side down), whereas the definitively differently colored firmness indicating zones 181-183 go up, resulting in the appearance readily apparent in the mattress 100 of FIG. 7.

Though also apparent from the drawings, it should be noted that the firmness indicating zones 181, 182 and 183 are coextensive in size and shape to the respective variable firmness panels 151, 152, 153 and the respective firmness zones 141, 142, 143. Therefore, when in use, equally obvious to a user are the firmness zone because of the relative firmness thereof evident by the firmness indicating zones 181, 182 and 183.

Although a preferred embodiment of the invention has been specifically illustrated and described herein, it is to be understood that minor variations may be made in the apparatus without departing from the spirit and scope of the invention, as defined by the appended claims.

What is claimed is:

1. A mattress comprising a polygonal border defined between upper and lower terminal peripheral edge portions and upper and lower panels collectively defining a substantially closed chamber, said border and panels being constructed from synthetic plastic material, means for bonding said upper panel to said border upper terminal peripheral edge portion, means for bonding said lower panel to said border lower terminal peripheral edge portion, a spring unit housed substantially in said chamber, said spring unit including a plurality of springs each having opposite upper and lower loop portions positioned substantially adjacent the respective upper and lower panels, an upper peripheral border rod located substantially adjacent said upper panel, means for securing at least selective ones of said springs to said upper peripheral border rod along the periphery of said upper peripheral border rod, said spring unit being devoid of a lower peripheral border rod at said springs lower loop portions, means for peripherally interlocking said upper peripheral border rod substantially against movement relative to said border and upper panel, said upper peripheral border rod being substantially interlocked against lateral and longitudinal movement by an upper inner peripherally extending distorted corner of said chamber defined by said upper panel and said polygonal border in interlocking relationship with said upper peripheral border rod, said spring unit being devoid of fabric pockets adapted to house springs, said plurality of springs setting-off at least three firmness zones including at least a head firmness zone, a leg firmness zone and a torso firmness zone between the head and leg firmness zones; a top fabric substantially covering said firmness zones, said top fabric being knit from threads of at least two different colors, said top fabric having interior and exterior surfaces, the threads at the exterior surface of said top fabric being knit to define three different firmness indicating areas corresponding to the three firmness zones, and at least one of said firmness indicating areas being defined by threads differing in color as compared to the color of the threads defining at least one of the two remaining firmness indicating areas.

2. The zoned mattress as defined in claim 1 wherein the threads of the two remaining firmness indicating areas are of substantially the same color.

3. The zoned mattress as defined in claim 1 wherein the threads of the two remaining firmness indicating areas are of substantially the same color, and said last-mentioned thread color is lighter than the thread color of the at least one firmness indicating area.

4. The zoned mattress as defined in claim 1 wherein the top fabric is circular knit.

5. The zoned mattress as defined in claim 1 including an inlay between the top fabric interior and exterior surfaces.

6. The zoned mattress as defined in claim 1 including an inlay of polymeric/copolymeric yarn between the top fabric interior and exterior surfaces.

7. The zoned mattress as defined in claim 1 wherein the three different firmness indicating areas each include a plurality of substantially identical repetitive pattern-defining areas, wherein two of the three different firmness indicating areas differ from the remaining one of the three different firmness indicating areas in color alone.

8. The zoned mattress as defined in claim 1 wherein the interior surface of the top fabric is substantially one color.

9. The zoned mattress as defined in claim 2 wherein the top fabric is circular knit.

10. The zoned mattress as defined in claim 2 including an inlay between the top fabric interior and exterior surfaces.

11. The zoned mattress as defined in claim 2 including an inlay of polymeric/copolymeric yarn between the top fabric interior and exterior surfaces.

12. The zoned mattress as defined in claim 2 wherein the three different firmness indicating areas each include a plurality of substantially identical repetitive pattern-defining areas, wherein two of the three different firmness indicating areas differ from the remaining one of the three different firmness indicating areas color alone.

13. The zoned mattress as defined in claim 3 including an inlay between the top fabric interior and exterior surfaces.

14. The zoned mattress as defined in claim 5 wherein the three different firmness indicating areas each include a plurality of substantially identical repetitive pattern-defining areas, wherein two of the three different firmness indicating areas differ from the remaining one of the three different firmness indicating areas in color alone.

15. The zoned mattress as defined in claim 5 wherein the interior surface of the top fabric is substantially one color.

* * * * *